United States Patent [19]

Young

[11] 4,194,363

[45] Mar. 25, 1980

[54] FLUID HORSEPOWER CONTROL SYSTEM

[75] Inventor: John E. G. Young, Watertown, N.Y.

[73] Assignee: General Signal Corporation, Stamford, Conn.

[21] Appl. No.: 13,493

[22] Filed: Feb. 21, 1979

[51] Int. Cl.[2] ..... F16H 39/46

[52] U.S. Cl. ..... 60/445; 60/452; 417/212

[58] Field of Search ..... 60/445, 448, 449, 450, 60/452; 417/212

[56] References Cited

U.S. PATENT DOCUMENTS 3,191,382 6/1965 Weisenbach ..... 60/389

3,856,436 12/1974 Lonnemo ..... 60/450 X

*Primary Examiner*—Edgar W. Geoghegan

*Attorney, Agent, or Firm*—Jeffrey S. Mednick; Thomas R. FitzGerald

[57] ABSTRACT

A fluid horsepower control system is adapted to operate a fluid load by output of a variable delivery pump having a control cylinder governed by a pressure compensated variable orifice connected in multiple with a load sense control valve for causing fluid flow to be inversely proportional to pump discharge pressure and maintaining constant drop across the orifice, without requiring mechanical feedback from the variable delivery pump to the load sense control valve.

7 Claims, 3 Drawing Figures

FLUID HORSEPOWER CONTROL SYSTEM

BACKGROUND OF THE INVENTION

The invention relates to fluid horsepower control systems, and it more particularly pertains to horsepower control systems for atmospheric variable delivery pumps.

Fluid horsepower control systems for atmospheric variable delivery pumps are known, for example, in the Weisenbach U.S. Pat. No. 3,191,382, which limits maximum system pressure by means of a pressure compensator, and which includes additional controls for maintaining a constant, relatively small pressure differential across a distributing valve at times when the valve is open and fluid is being metered to a load. This system provides a substantially constant discharge pressure for the pump which is substantially lower than the compensator setting during periods when the distributing valve is closed. Thus, the pump flow and pressure is maintained within specific input horsepower values, the pressure compensator and distributing valve being made displacement sensitive by means of mechanical feedback indicative of the displacement of the pump. This permits substantially full utilization of horsepower input of a prime mover.

An object of the present invention is to provide a fluid horsepower control system which substantially obviates one or more of the limitations of the described prior systems.

Another object of the present invention is to provide an improved, simplified, and less expensive fluid horsepower control system.

Other objects, purposes and characteristic features of the present invention will be in part obvious from the accompanying drawings and in part pointed out as the description of the invention progresses.

SUMMARY OF THE INVENTION

A fluid horsepower control system has been provided that is adapted to operate a variable fluid load by output of a variable displacement pump having a control cylinder governed by flow and pressure control means for regulating displacement of the pump. A normally open flow control valve device is provided having a pressure compensated variable orifice connected between output of the pump and input to a fluid load for maintaining a pump discharge rate of flow from the pump to the load that is inversely proportional to the pump discharge pressure. A load sense control valve device is provided that is governed by pressure differential across the orifice for selectively applying or relieving pressure on a piston of the control cylinder of the pump to adjust pump displacement for maintaining substantially constant maximum horsepower output of the pump under variable load conditions.

For a better understanding of the present invention, together with other and further objects thereof, reference is had to the following description taken in connection with the accompanying drawings, while its scope will be pointed out in the appending claims.

IN THE DRAWINGS

Figure 1:
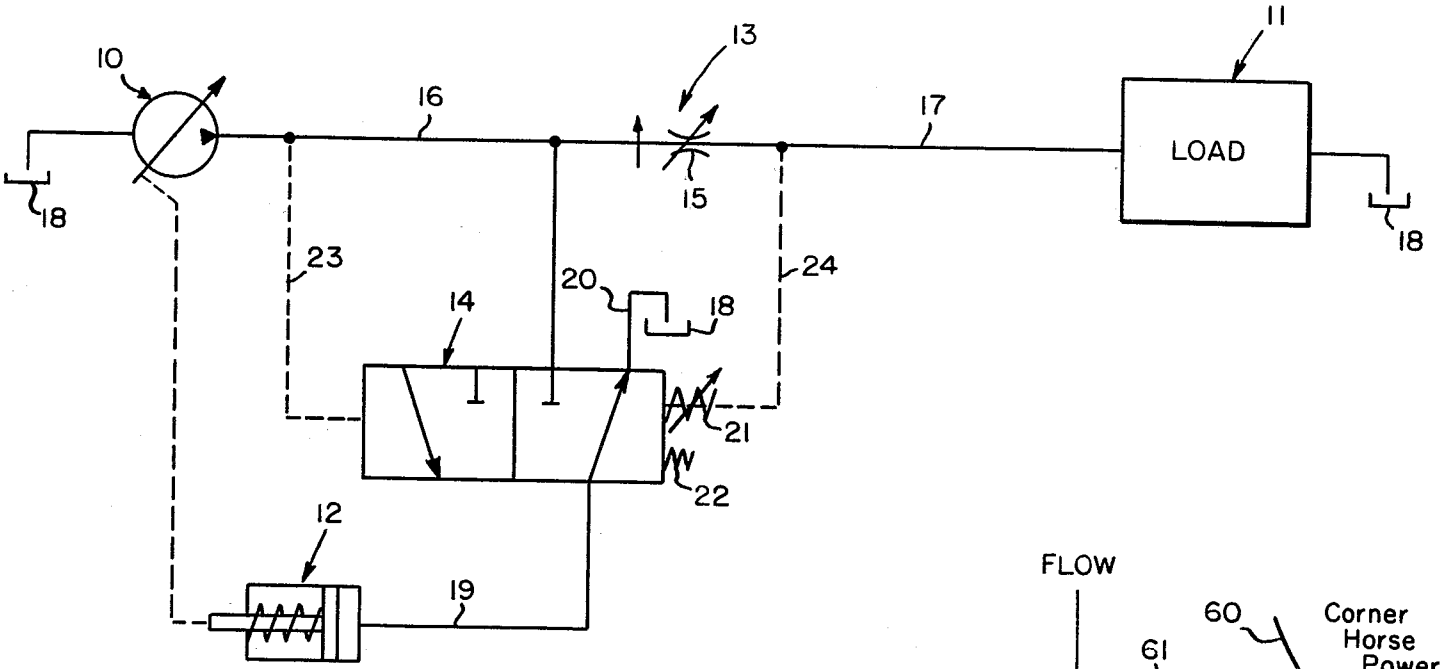
FIG. 1 is a schematic illustration of a fluid horsepower control system according to a preferred embodiment of the present invention.

With reference to FIG. 1, a variable displacement pump 10 is provided for discharging fluid to operate a variable load 11. The displacement of pump 10 is governed by a control cylinder 12, which is in turn actuated by flow and pressure control devices 13 and 14 respectively. The flow control device 13 has a variable orifice 15 that is governed by discharge pressure of pump 10 which is applied to passage 16. The downstream side of the orifice 15 is connected by passage 17 to the load 11, with return from the load 11 to the pump 10 being through an atmospheric tank 18. The load sense control valve 14 is a three-way valve that selectively pressurizes the control cylinder 12 from passage 16 over passage 19, or relieves pressure from the cylinder 12 over passage 19 and passage 20 to the tank 18. The load sense control device 14 is biased by a first spring 21 and a second spring 22 in combination with sensing differential pressures across the variable orifice 15 over pilot passages 23 and 24 connected upstream and downstream respectively relative to the orifice 15.

The variable orifice 15 is so compensated by pump discharge pressure applied over passage 16 acting against a spring to provide a pump discharge flow that is inversely proportional to pump discharge pressure. This provides a constant pressure drop across the orifice 15, and the load sense control in multiple with the compensated orifice 15 positions the cam of pump 10 to reduce the pump discharge pressure for light loads.

Figure 2:
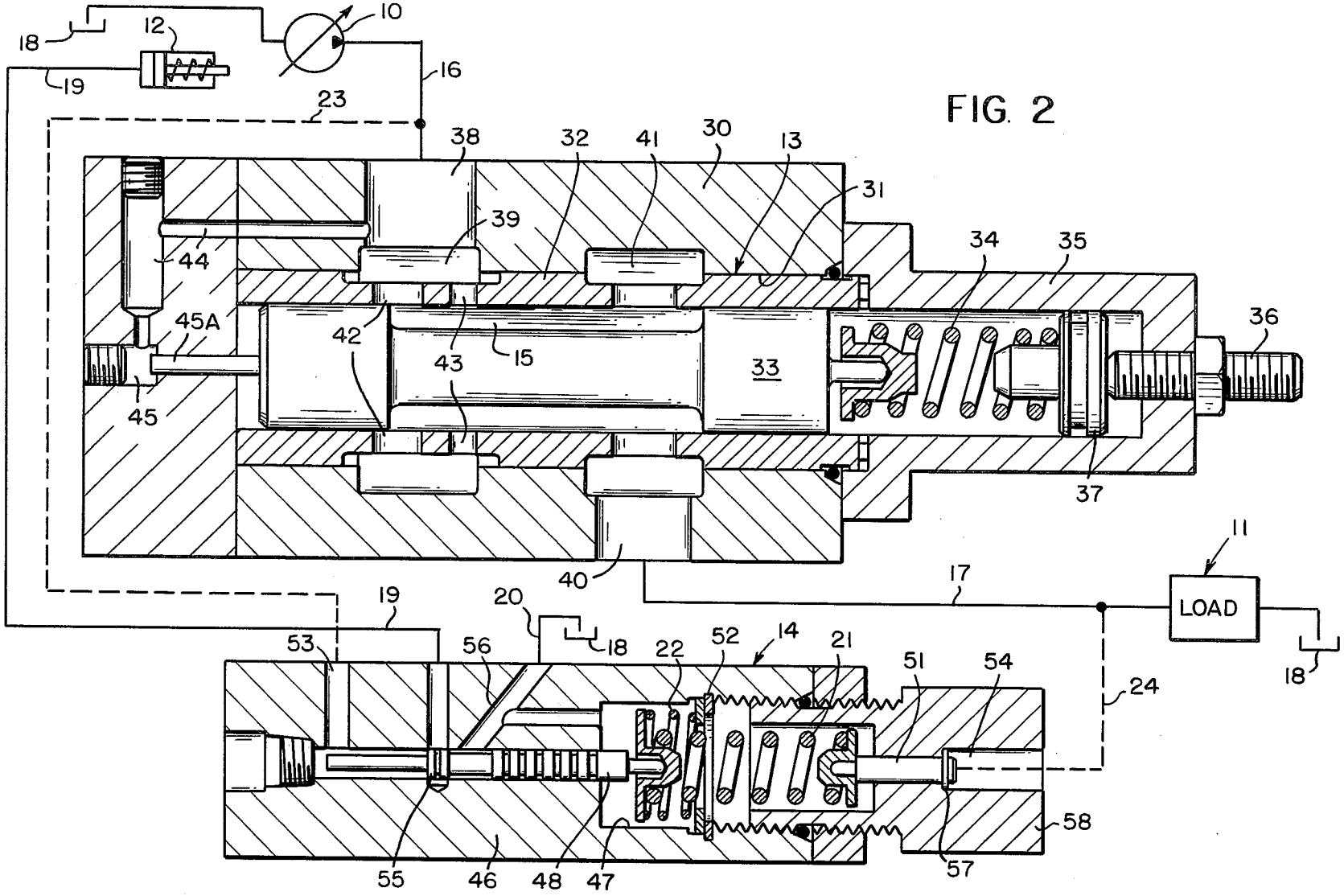
FIG. 2 illustrates, partly by cross section, detail structure of some of the components of the system illustrated in FIG. 1.

To consider the structure of the fluid horsepower control system more specifically, with reference to FIG. 2, the flow control device 13 comprises a housing 30 having a bore 31, in which is inserted a fixed valve sleeve 32. A spool 33 is slidable longitudinally within the sleeve 32, the spool 33 being biased to the left by a spring 34 contained in a detachable housing 35 and adjustable by the rotation of a threaded adjustment pin 36. The spring 34 is disposed between an adjustable piston 37 and the right-hand end of the spool 33.

Pump discharge pressure input to the flow control valve 13 is applied at port 38 in the housing 30, the port 38 being connected to an annular input valve chamber 39 formed in part in the housing 30 and in part in the sleeve 32. Similarly, an output port 40 is formed in the housing 30 at a point spaced longitudinally from the input port 38, having an annular chamber 41 connected thereto and formed in part in the housing 30 and in part in the sleeve 32.

The spool 33 has a longitudinal recess forming the variable flow passage 15 in cooperation with relatively large and small openings 42 and 43 respectively through the sleeve 32 to provide for a variable flow path from the input port 38 to the output port 40 as the spool 33 is reciprocated within the sleeve 32. A pilot passage 44 connects the input port 38 to a chamber 45 at the left-hand end of a pressure sense pin 45A. Thus, pump discharge pressure is applied through passage 44 to the left-hand end of spool 33 in opposition to the force of spring 34 which is disposed between the right-hand end of spool 33 and the adjustable piston 37.

The load sense control valve 14 comprises a housing 46 having a stepped longitudinal bore 47 for receiving in its left-hand portion a valve spool 48, and in its right-hand portion first and second springs 21 and 22. The first spring 21 is disposed between the right-hand end of spool 48 and the left-hand end of a load sense pin 51. The second spring 22 is disposed between a retaining ring 52 in the housing 46 and the right-hand end of the valve spool 48. The valve spool 48 is subject to pump discharge fluid pressure applied to the left-hand end of the spool 48 through a port 53, and the right-hand end of spool 48 is subject to load pressure applied over pilot passage 24 through a chamber 54, load pin 51 and the spring 21. A land 55 on spool 48 selectively connects the left-hand end of the control cylinder 12 through passage 19 to the discharge pressure output of the pump 10 over pilot passage 23, or to the tank 18 through a passage 56.

In operation, when the load sense control device 14 is under no load conditions, the load sense control valve 14 has low pressure applied at its right-hand end over pilot passage 24, and thus the opposing pump discharge pressure moves the spool 48 to the right, subject to limitation of spring 22, to maintain a desired pump idling pressure that can be, for example, about 200 p.s.i. This applies relatively low input pressure to the compensated flow valve 13, thus permitting that valve to substantially fully open by moving its spool 33 to the left to permit flow of fluid with little resistance but at a low rate because of the low pump discharge pressure. Upon the application of a load to the system, pressure builds up in the pilot passage 24, and acts on the load pin 51 to compress spring 21 from its right-hand end. This moves the spool 48 to the left, and permits the venting of fluid from the control cylinder 12, to in turn permit operation of the cam of pump 10 toward its full stroke position.

At all system pressures, the spring 21 in the load sense valve 14 is compressed between pump discharge pressure applied over pilot pressure 23 to the left of spool 48 and load pressure working against an equal area on the sense pin 51. The spring 21 shortens in proportion to the pressures working on its opposite ends, but all the shortening takes place from its right-hand end until load pin 51 has travelled its full stroke because the biasing spring 22 holds the spool 48 in its extreme leftward position, and the pump 10 remains on full stroke. This remains true as long as pump discharge pressure does not exceed load pressure more than a fixed amount, governed by the spring 22, which can be, for example, 100 p.s.i. above actual pressure reflected from the load 11. However, if flow through the variable orifice 15 should become excessive and create a pressure drop greater than 100 p.s.i., pump discharge pressure applied over pilot passage 23 would cause the spool 48 to be moved toward the right, compressing the spring 22 as well as the spring 21 to cause fluid to be directed to control cylinder 12 via passage 23, port 53 and passage 19 effectively reducing pump displacement to maintain 100 p.s.i. drop across the orifice 15.

If there should be an overload, causing both pump discharge pressure and load pressure to rise to a high value, the relatively heavy spring 21 would be compressed from both ends, but the spool 48 would remain in its extreme leftward position until the load sense pin 51 would be actuated to the end of its stroke, as limited by its retaining ring 57. A further rise in pump discharge and load pressure would further compress the spring 21, but now the shortening would be on the left end, as the spool 48 would be moved into a compensating position for venting the control cylinder 12. Thus, the maximum pressure is normally limited by the point at which the spool 48 will be moved to the right under an overload condition, as established by the adjustment of the force of spring 21. Adjustment of spring 21 is obtained by turning an adjustment nut 58.

By use of the flow control valve device 13 in multiple with the load sense control valve device 14 and in series with the load 11, flow is reduced through the variable orifice 15 and through the load 11 as the pump discharge pressure increases as sensed by the variable orifice 15. This permits continued operation at substantially constant horsepower output of the pump 10 without overloading the prime mover by operating out to the "corner" horsepower capability of the pump 10.

Figure 3:
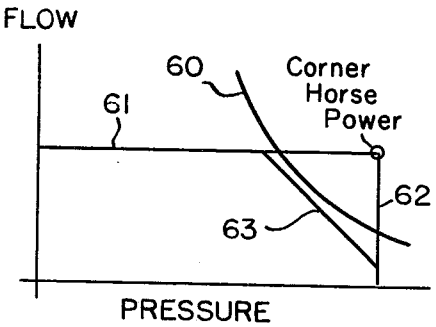
FIG. 3 illustrates diagrammatically how displacement of the pump is automatically adjusted relative to pump discharge pressure to maintain substantially constant horsepower output under varying pump discharge pressure conditions.

The mode of operation of the system as it has been described results in operating characteristics as shown in FIG. 3 wherein the curve 60 illustrates a constant torque curve of a prime mover for actuating the pump 10, the line 61 shows maximum rate of flow in the load circuit, and the line 62 represents the maximum setting of the load sense device 14. In a system having mechanical torque feedback from th cam of a variable delivery pump, such as in the above mentioned Weisenbach U.S. Pat. No. 3,191,382, the mechanical feedback control acting on both a flow control valve and a pressure compensator can cause delivery of substantially constant horsepower along a curve similar (allowing for losses) to the curve 60 of the prime mover input to a pump. The system according to the present invention, with the orifice 15 controlled by pump discharge pressure to provide that pump discharge flow is substantially inversely proportional to pump discharge pressure, permits substantially maximum use of the horsepower input by delivering substantially constant maximum horsepower output as represented by the line 63, which is at an angle substantially tangent to the input torque curve 60, without requiring mechanical feedback from the cam of the pump 10. Thus, a substantial savings results from the reduction in the amount of mechanical linkage necessary and reduction in cost of the valves, while maintaining comparable operating characteristics of the hydraulic circuit.

Having thus described a fluid horsepower control system as a preferred embodiment of the present invention, it is to be understood that various modifications and alterations may be made to the specific embodiment shown without deparating from the spirit or scope of the invention.

What is claimed is:

1. A fluid horsepower control system adapted to operate a variable fluid load by output of a variable displacement pump having a variable cam and a control cylinder governed by flow and pressure responsive means for regulating displacement of the pump wherein improved pressure and flow responsive means for governing the variable displacement pump comprises;

(a) normally open flow control means having a pressure compensated variable orifice connected between output of the pump and input to a fluid load for maintaining a pump discharge rate of flow from the pump to the load inversely proportional to the pump discharge pressure, and (b) load sense control valve means governed by pressure differential across the orifice for selectively applying or relieving pressure on a piston of the control cylinder of the pump to adjust pump displacement to maintain substantially constant maximum horsepower output of the pump under variable load conditions;

(c) whereby the load can utilize substantially constant horsepower approaching a prime mover input torque curve without requiring mechanical feedback from the cam of the pump.

2. A fluid horsepower control system according to claim 1 wherein the flow control means comprises:

(a) housing means having a bore with axially spaced input and output annular recesses formed therein, the recesses being connected to input and output ports respectively, and (b) spool valve means disposed within the bore having a spool axially operable in a flow reducing direction within the bore by pump discharge pressure acting in one direction on the spool, the spool being biased in the opposite direction by a spring.

3. A fluid horsepower control system according to claim 2 wherein means is provided for adjusting the biasing force of the spring, and means is provided for retaining the spring in a removable cap at one end of the housing to facilitate the selective use of springs adapted for generating different forces.

4. A fluid horsepower control system according to claim 2 wherein the spool has a recessed mid-portion for metering connection of the input and output ports.

5. A fluid horsepower control system according to claim 4 wherein a sleeve liner is inserted in the bore having radial passages of different sizes connecting one of the recesses of the bores with the recessed mid-portion of the spool for variably restricting flow of fluid in inverse proportion to pump discharge pressure applied to the spool in opposition to the spring.

6. A fluid horsepower control system according to claim 1 wherein the load sense control valve means comprises:

(a) a valve housing having a longitudinal bore, (b) a longitudinally operable spool within the bore having a land selectively operable to at times permit flow of pump discharge fluid to the control cylinder and at other times to permit flow of fluid from the control cylinder to a tank, (c) spring biasing means comprising first and second coaxial springs acting on the spool at one end for biasing the spool in a given direction to cause the control cylinder to position the pump on full stroke delivery, and (d) differential fluid biasing means acting on the spool comprising;

(1) a pilot pressure obtained downstream from the flow control means acting in said given direction on the spool through the first spring, and (2) a pilot pressure obtained upstream from the flow control means acting in the opposite direction on the spool for causing destroking of the pump when a differential fluid pressure across the spool in said opposite direction is such as to overcome the biasing force of the springs and cause the spool to permit flow of fluid from the pump to the control cylinder.

7. A fluid horsepower control system according to claim 6 wherein the second spring is disposed between the housing and said one end of the spool.

* * * * *